US009912062B1

(12) United States Patent
Matasek

(10) Patent No.: US 9,912,062 B1
(45) Date of Patent: Mar. 6, 2018

(54) SUPPORT FOR CIRCUIT TRACES

(71) Applicant: Amazon Technologies, Inc., Reno, NV (US)

(72) Inventor: Jeffrey Alan Matasek, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 393 days.

(21) Appl. No.: 13/929,602

(22) Filed: Jun. 27, 2013

(51) Int. Cl.
*H01Q 9/04* (2006.01)

(52) U.S. Cl.
CPC ..... *H01Q 9/045* (2013.01)

(58) Field of Classification Search
CPC ..... H01C 1/243; H01C 9/045
USPC ..... 343/906
See application file for complete search history.

(56) References Cited

U.S. PATENT DOCUMENTS 6,426,724 B2 * 7/2002 Gunee ..... H01Q 1/088 343/700 MS
2003/0169205 A1 * 9/2003 Gioia ..... H01Q 1/088 343/702
2010/0238621 A1 * 9/2010 Tracy ..... B29C 45/14639 361/679.27
2011/0057858 A1 * 3/2011 Yan ..... B29C 45/0053 343/878
2011/0057859 A1 * 3/2011 Rho ..... H01Q 1/243 343/893
2011/0134015 A1 * 6/2011 Yang ..... B29C 45/1671 343/878
2011/0234473 A1 * 9/2011 Taguchi ..... H01Q 1/38 343/906
2011/0304511 A1 * 12/2011 Fan ..... H01Q 1/243 343/702

* cited by examiner

*Primary Examiner* — Dameon E Levi
*Assistant Examiner* — Walter Davis
(74) *Attorney, Agent, or Firm* — Lee & Hayes, PLLC

(57) ABSTRACT

Electronic devices may include substrates with integrated circuit traces. For example, a component of an electronic device may include a substrate with one or more circuit traces formed on the substrate. A support structure may be embedded in the substrate at a location proximate to at least a part of a circuit trace of the one or more circuit traces. A connector may be affixed to at least the support structure and at least a portion of the part of the circuit trace. This disclosure also describes techniques for assembling substrates with circuit traces and embedded support structures.

20 Claims, 10 Drawing Sheets

SUPPORT FOR CIRCUIT TRACES

BACKGROUND

A large and growing population of users is enjoying entertainment through the consumption of digital content, such as music, movies, images, electronic books, and so on. The users employ various electronic devices to consume such content. Among these electronic devices are electronic book (eBook) reader devices, cellular telephones, personal digital assistants (PDAs), portable media players, tablet computers, netbooks, and the like. Substrates with integrated circuit traces are often utilized in these devices. Finding ways to enhance the construction, compactness, and survivability of such substrates with integrated circuit traces has become a priority.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
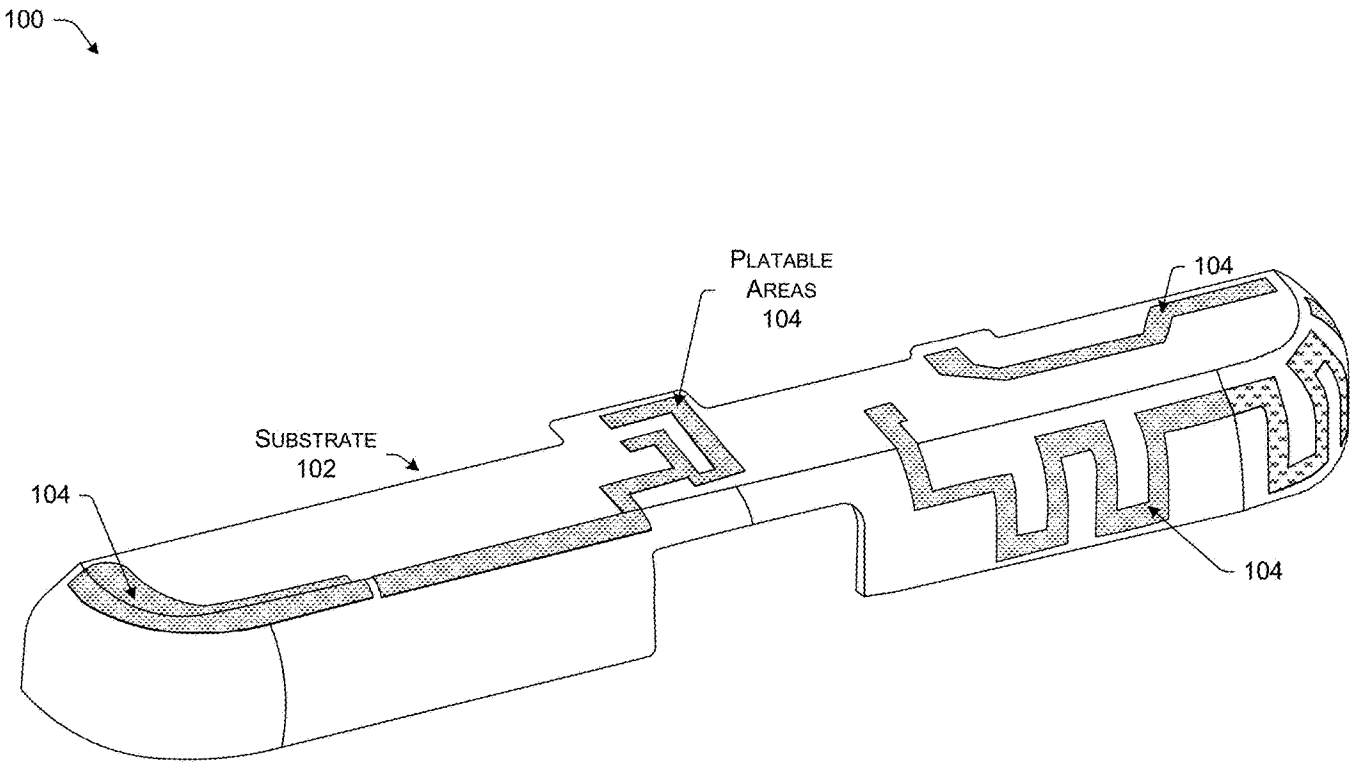
FIG. 1 illustrates an example substrate with platable areas corresponding to a pattern circuit traces.

This disclosure describes, in part, substrates with integrated circuit traces formed thereon and support structures for the integrated circuit traces which support the integrated circuit traces when items such as connectors (e.g. RF connectors) or cables are joined (e.g. soldered) to the circuit traces and the support structure. For example, substrates with circuit traces may be molded interconnect devices (MIDs). An MID may be an injection-molded thermoplastic part with integrated electronic circuit traces. For example, some antennas are MIDs. This disclosure also describes techniques for manufacturing substrates including circuit traces and support structures.

In some implementations, the substrates may include thermoplastic components (e.g. plated plastics) or epoxy laminate components (e.g. printed circuit board substrates). In some implementations, a support structure for a circuit trace may include a metal component embedded in the substrate at a location proximate to the circuit trace to be supported. For example, in an implementation in which the substrate is a thermoplastic component, the support structure may include a metal piece that is insert molded at the appropriate location in the thermoplastic. In another example implementation, the support may take the form of a metal staple that is inserted into an already formed thermoplastic component by a thermal insertion process (e.g. heating at least a part of the support to the point that the support melts the plastic of the component and then pressing the support into the desired location) or ultrasonic insertion (e.g. vibrating the support to the point that the vibrational energy transferred to the plastic melts the plastic and then pressing the support into the desired location). Of course, these are merely examples and other techniques for embedding support structures or components within substrates at the time the substrate is formed or after the substrate is formed may be utilized (another example being thermoplastic welding). Moreover, depending on the particular technique selected, in some implementations, the support structure may be embedded within the substrate before the circuit traces are formed on the substrate. In other implementations, the support structure may be embedded within the substrate after the circuit traces are formed on the substrate.

Although implementations are described herein with reference to thermoplastic substrates and to a laser direct structuring process for forming circuit traces on the thermoplastic substrates, this is for ease of description only. Other materials and technologies may be utilized without departing from the scope of the present disclosure and the processes and techniques described herein may be implemented in any number of ways. For example, in some implementations, rather than forming the circuit traces by using a laser direct structuring process, other techniques such as "two-shot" molding or padded printing may be used (an example implementation utilizing "two-shot" molding is set forth with regard to FIGS. 9 and 10). Example implementations are provided below with reference to the following figures.

Figure 2:
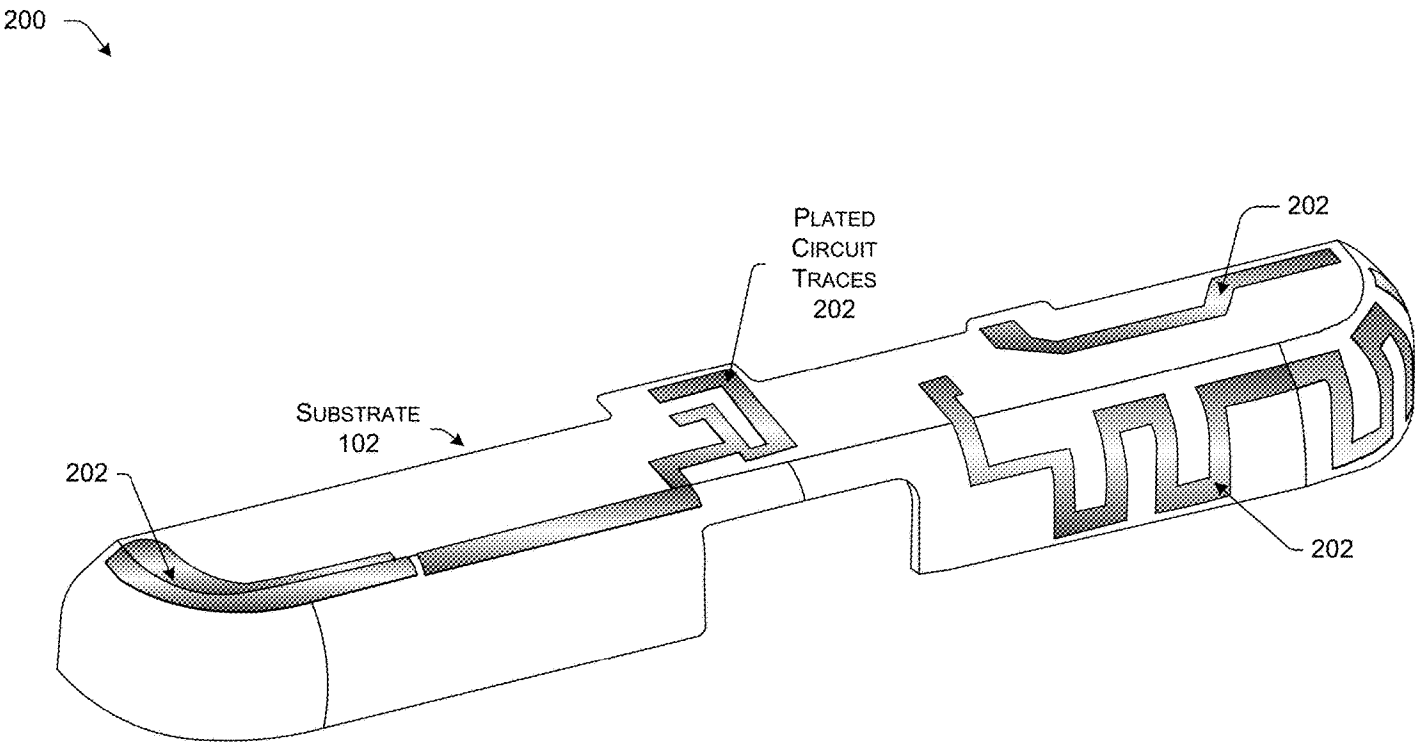
FIG. 2 illustrates the example substrate of FIG. 1 following the plating of the platable areas to form integrated circuit traces.

FIGS. 1 and 2 illustrate example views 100 and 200 of a substrate 102 before and after the formation of circuit traces on the substrate 102, respectively.

In particular, as shown in FIG. 1, the substrate 102 may be a thermoplastic component that includes several platable areas 104 that form circuit traces when subjected to an electroless copper bath. The result of subjecting the substrate 102 of FIG. 1 to an electroless copper bath is shown in FIG. 2, where the platable areas 104 are metalized such that plated circuit traces 202 form on the platable areas 104. Two example processes for creating platable areas on a thermoplastic component are laser direct structuring and two-shot molding. These example processes are discussed below.

Laser direct structuring uses a thermoplastic material, doped with a metal-plastic additive that can be activated by means of a laser. The thermoplastic component may be formed by single-component injection molding. After the thermoplastic component is formed, a laser may be utilized to "write" the course of the circuit traces on the plastic. In some implementations, where the laser beam hits the plastic, the metal additive forms a micro-rough track. The metal particles of this track form the nuclei for the metallization of the circuit traces. For example, when placed in an electroless copper bath, the circuit traces form on these tracks. Electroless plating, also known as chemical or auto-catalytic plating, is a non-galvanic plating method that may involve several simultaneous reactions in an aqueous solution, which may occur without the use of external electrical power. The reaction may be accomplished when hydrogen is released by a reducing agent, such as sodium hypophosphite, and oxidized, which may produce a negative charge on the surface of the substrate. An example electroless plating method is electroless nickel plating, although silver, gold and copper layers can also be applied in this manner. Additional layers of copper, silver, nickel and gold finish may also be raised in this way.

In two shot molding, the thermoplastic component is formed by an injection molding process using two different resins, one of which is platable and the other is not. In some implementations, the platable resin may be acrylonitrile butadiene styrene (ABS) and the non-platable resin may be polycarbonate. When the two shot molded thermoplastic component is subjected to an electroless plating process, the butadiene chemically roughens the surface of the platable area and allows adhesion of the circuit traces. The plating chemistry can be controlled to prevent the roughening of the polycarbonate portions of the component.

As mentioned previously, the above described processes are merely examples provided to allow a better understanding of the disclosed subject matter. Other processes and/or substrates may also be utilized. For example, while electroless plating is referred to herein as an example technique for forming circuit traces on various substrates, other techniques or combinations of techniques may be used such as electroplating, metallizing and so on.

Figure 3:
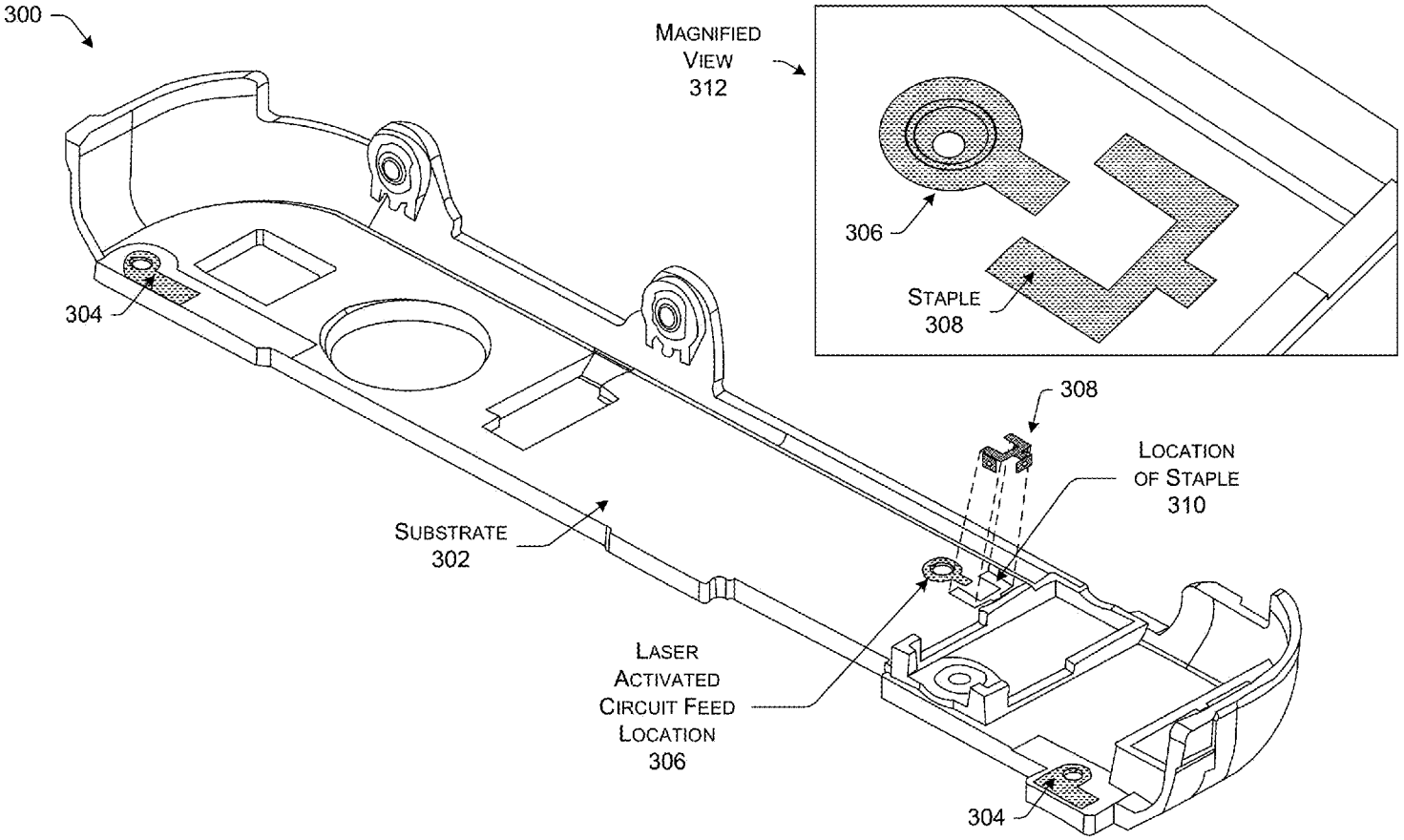
FIGS. 3 and 4 each illustrate a view of a substrate with platable areas that has an embedded structural support of plated integrated circuit traces corresponding to the plated areas.
Figure 4:
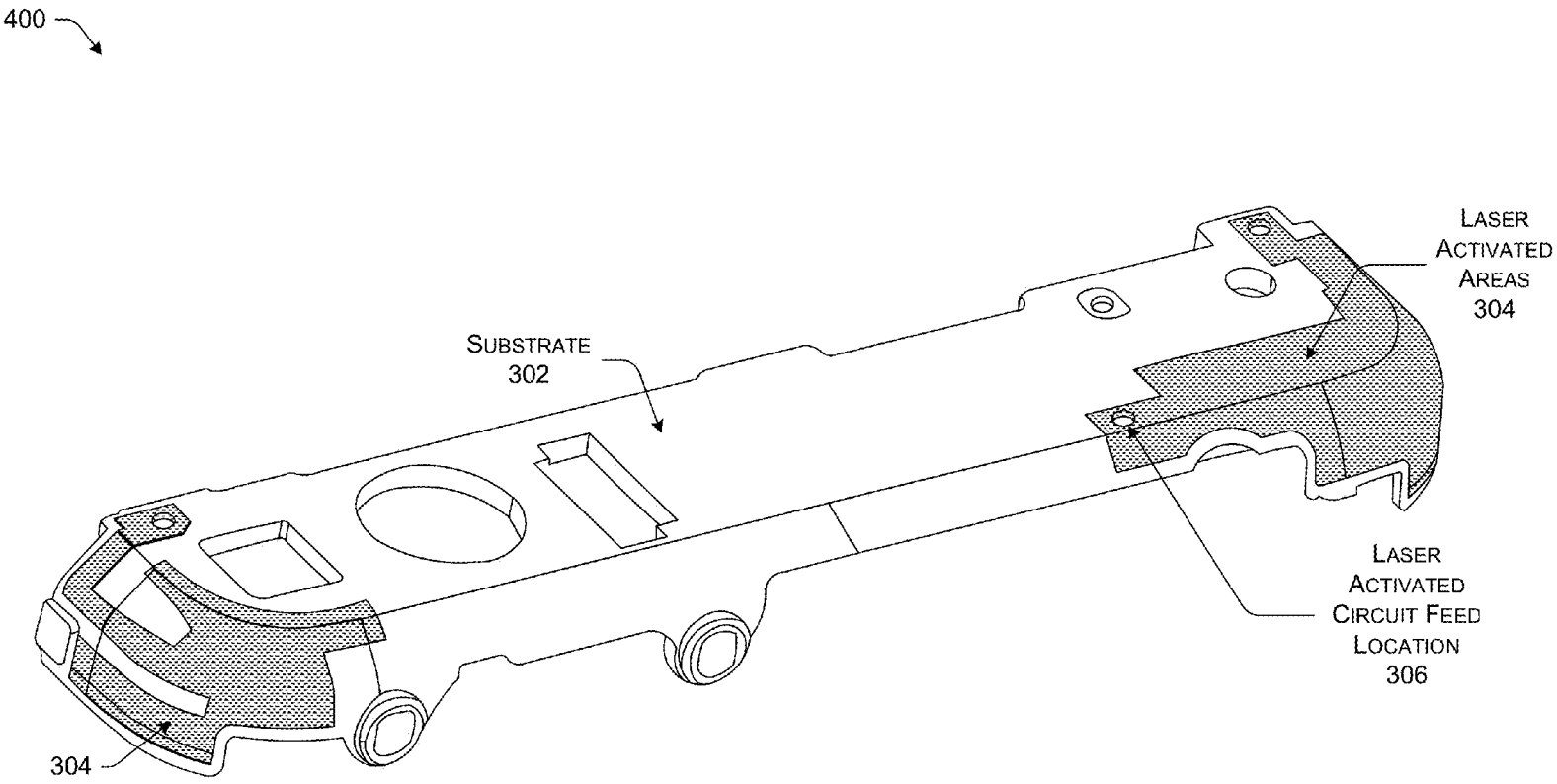

FIGS. 3 and 4 illustrate views 300 and 400 of a substrate 302, respectively, that includes a support structure for circuit traces. In particular, view 300 illustrates a bottom or inside view of the substrate 302 to which a connector is to be soldered to a circuit feed. View 400 shows a top or outside view of the substrate 302.

The substrate 302 is illustrated as a thermoplastic component formed using laser direct structuring and includes laser activated areas 304 and a laser activated circuit feed location 306. In addition, the substrate 302 includes a staple 308 that acts to support the circuit traces at the feed location 306. In particular, the staple 308 is positioned in the substrate at location 310 which is proximate to the circuit feed location 306. Though the staple 308 is shown above the substrate 302 in the primary view, this is merely to show an example form factor of the staple 308. Rather, as shown in the magnified view 312, the staple 308 is embedded in the substrate 302 at the location 310.

As mentioned above, FIG. 4 provides a top or outside view 400 of the substrate 302. In particular, the substrate 302 is illustrated as including laser activated areas 304 on the top side of the substrate 302 as well as the other side of a through hole of the circuit feed (indicated once again as the laser activated circuit feed location 306).

As discussed previously, the staple 308 may be embedded in the substrate 302 through various techniques. Two examples of suitable techniques include insert molding and thermal insertion. In the case of insert molding, the staple 308 would be positioned in the mold used to form the substrate 302 at a position corresponding to location 310. Thermoplastic material would then be injected into the mold and allowed to harden. Once the substrate 302 is formed and the staple is embedded therein, the substrate 302 may be subjected to the laser activation of the areas 304 and 306. In the case of thermal insertion, the substrate 302 may be pre-formed. Once the substrate 302 is hardened, the staple 308 may be heated to the point that the staple 308 melts the plastic of the substrate 302 and may then be pressed into location 310. As the plastic of the substrate 302 cools, the plastic shrinks around the staple 308, capturing or affixing it in place.

The example staple 308 shown in FIG. 3 includes a flat top surface formed into three "wings" that are each connected to a straight bar. A fin extends from an "outside" edge of each wing in a substantially perpendicular or downward direction with respect to the flat top surface. Each fin is substantially rectangular with a hole through the face of the fin. Once inserted or molded into the thermoplastic of the substrate 302, liquefied or molten thermoplastic of the substrate 302 may fill the holes in the faces of the fins, thereby increasing the hold of the thermoplastic on the staple 308. Of course, the particular shape and material of the staple may vary from implementation to implementation without departing from the scope of this disclosure.

Additionally, while the implementations provided herein include a circuit feed location, implementations are not so limited and may include any type of signal location or circuit trace location instead of or in addition to a circuit feed location.

Figure 5:
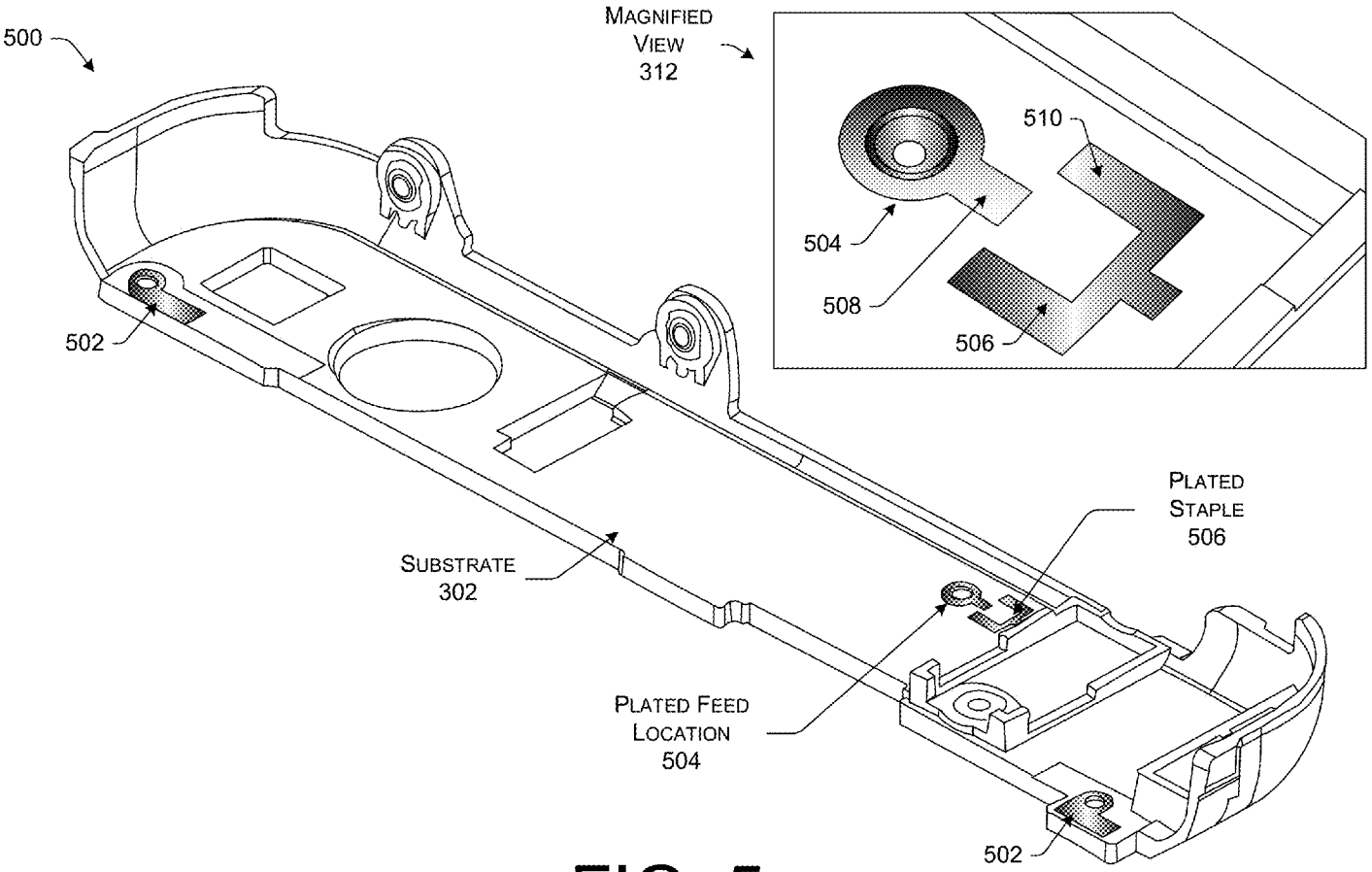
FIGS. 5 and 6 each illustrate views of the substrate of FIGS. 3 and 4 following the plating of the platable areas.
Figure 6:
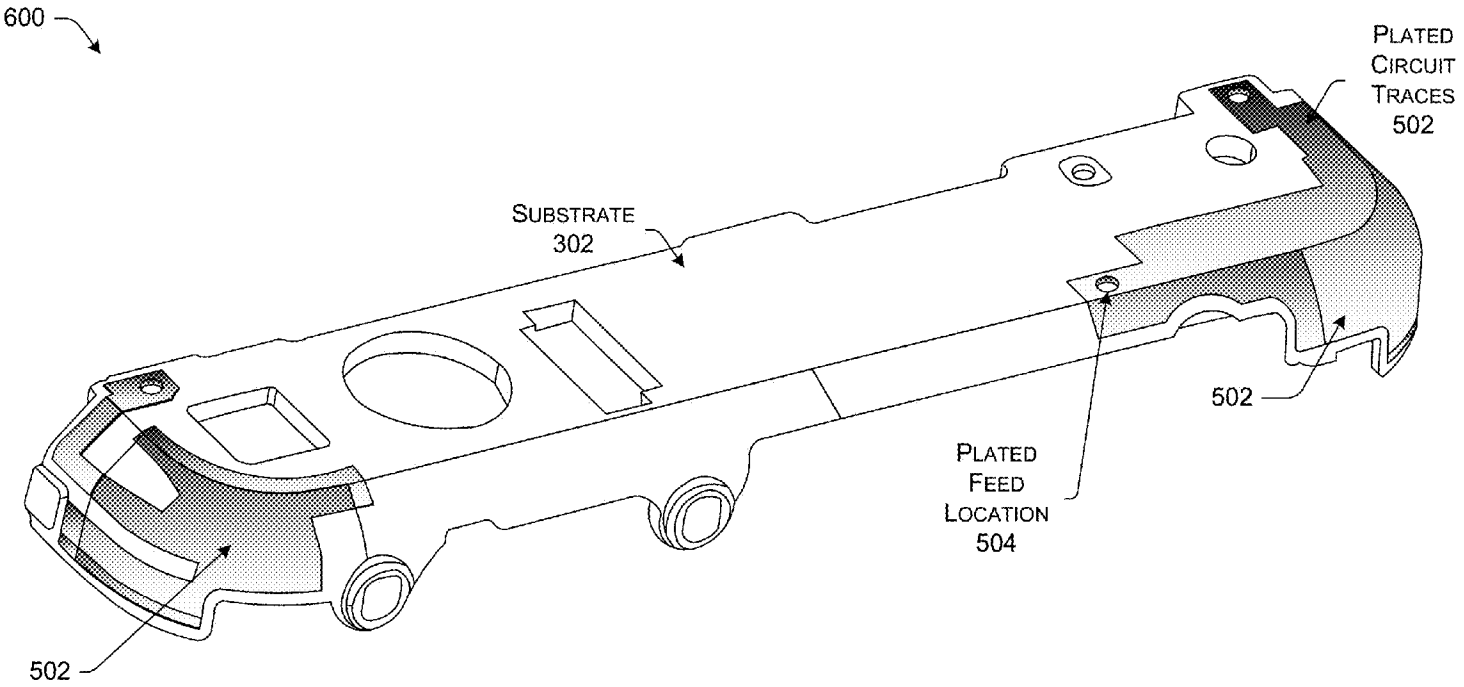

FIGS. 5 and 6 illustrate views 500 and 600 of the substrate 302 subsequent to the substrate 302 being subjected to metallization (e.g. through being placed in an electroless copper bath). In particular, each of the laser activated areas 304, the circuit feed location 306 and the staple 308 have been plated to become the plated circuit traces 502, the plated feed location 504 and the plated staple 506. The plated circuit feed location 504 and plated staple 506 are again shown in the magnified view 312. The magnified view 312 also shows a first attachment point 508 where a connector can be soldered or otherwise attached to the plated feed location 504, and a second attachment point 510 where the connector can be soldered or otherwise attached to the exposed surface of the plated staple 506.

Figure 7:
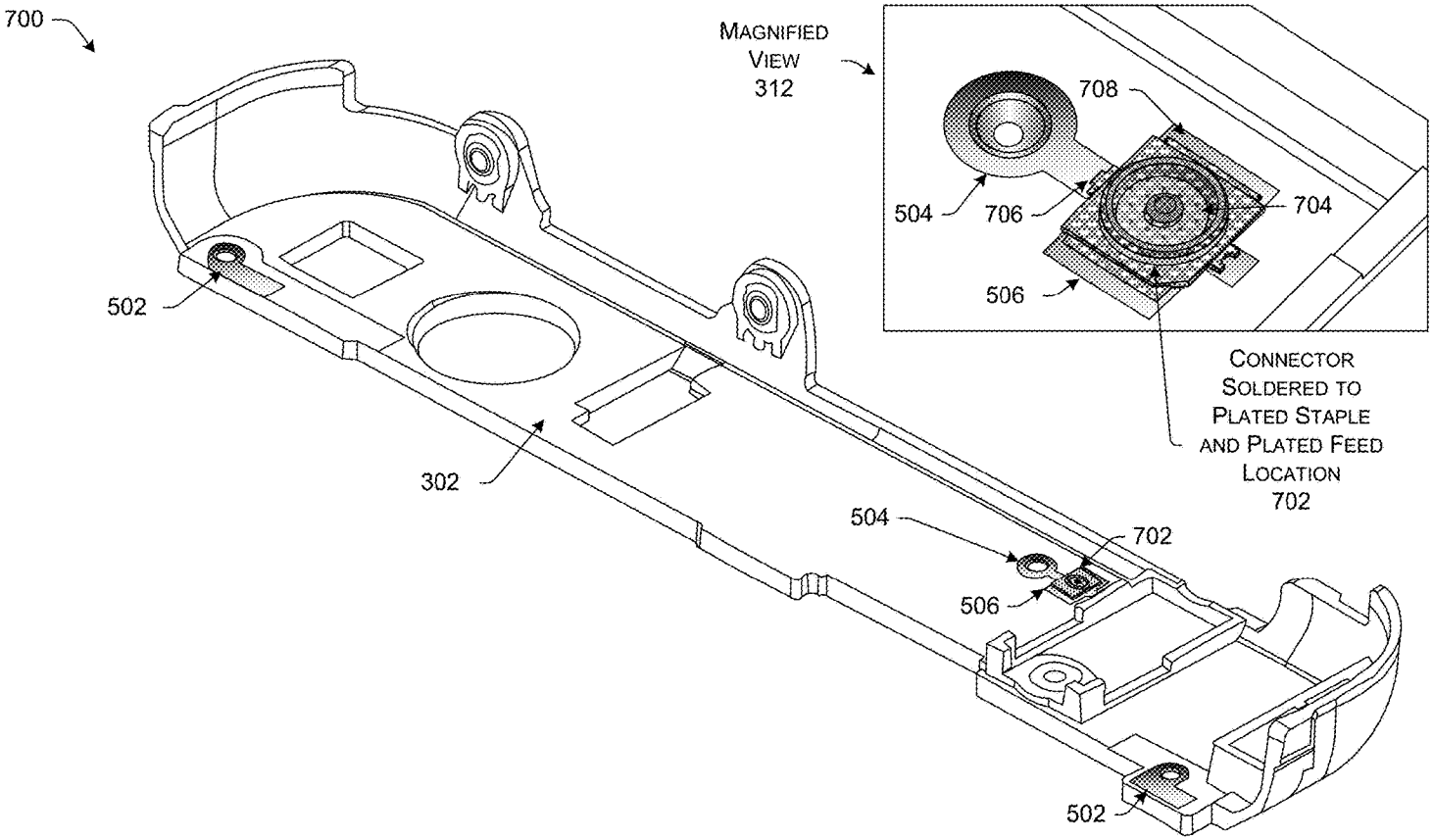
FIG. 7 illustrates a view of the substrate shown in of FIGS. 3 and 5 with a connector affixed to the plated circuit traces and an embedded support structure of the substrate.

FIG. 7 illustrates a view 700 of the substrate 302 in which a connector 702 has been soldered to the plated circuit feed location 504. In particular, as shown in the magnified view 312 of FIG. 7, the connector may be soldered to the substrate 302 such that the soldering bonds the connector 702 to both the plated circuit feed location 504 and the plated staple 506. For example, a first soldering joint 706 may connect the connector 702 to the circuit feed location 504, and a second soldering joint 708 may connect the connector 702 to the plated staple 506. As such, the staple 506 bears at least some of the stresses that would otherwise be experienced by the bond (e.g., soldering joint 706) between the circuit traces of the circuit feed location and the thermoplastic of the substrate 302. Because the staple 506 is embedded in the thermoplastic of the substrate 302, the amount of force or stress that may be applied to the connector 702 without causing failure may be increased.

The substrates, components and processes described above and illustrated in FIGS. 1-7 are merely examples and, as such, implementations are not limited to these examples. For example, as mentioned above, the substrates according to this disclosure are not limited to those in which the above described substrate is formed of a thermoplastic. Further, the staple 308 described in the example implementation is not the only shape, design or material contemplated as within the scope of this disclosure for use in a support structure and may vary from implementation to implementation based on many factors (e.g. the composition of the substrate, the time of placement and the location of the staple in the substrate, aesthetic considerations, temperatures the substrate will be subjected when the staple is embedded within the substrate, stresses that may be applied to the staple, etc.). These and other features, variations and/or components would be apparent to one of ordinary skill in the art in view of this disclosure.

Figure 8:
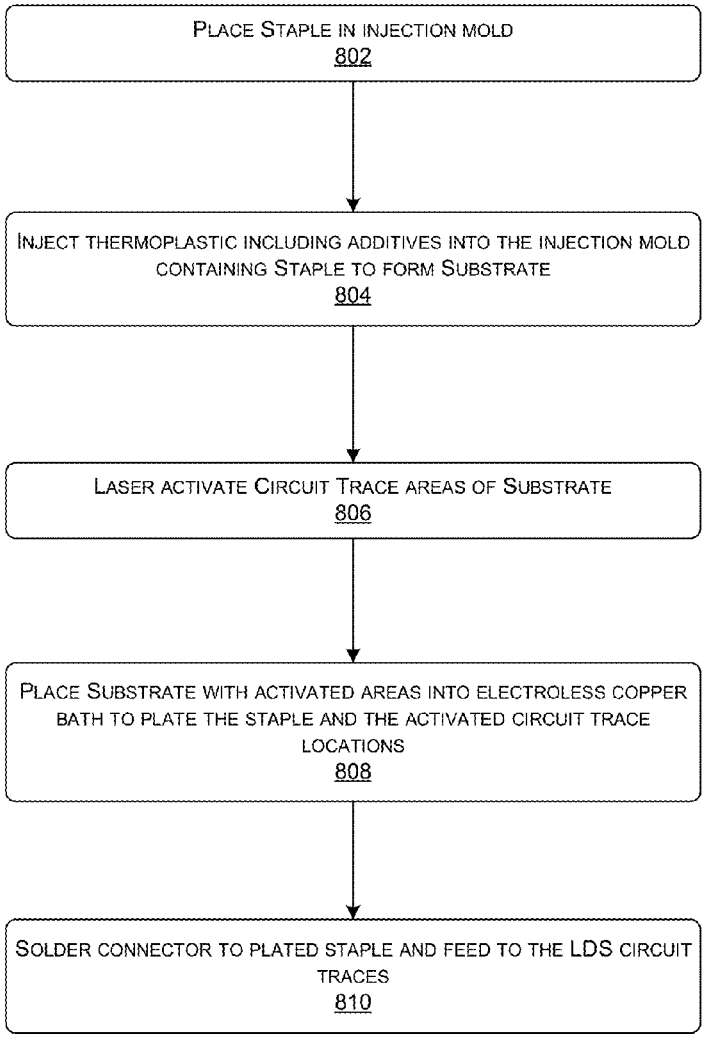
FIG. 8 illustrates an example flow diagram of a process for assembling a substrate with integrated circuit traces such as that shown in FIG. 7.

FIG. 8 illustrates an example process 800 for assembling a substrate including circuit traces, a connector and a supporting structure for the connector and circuit traces. The order in which the operations are described is not intended to be construed as a limitation, and any number of the described operations can be combined in any order and/or in parallel to implement the process.

The process 800 includes, at 802, placing a staple, such as staple 308, or a similar component in an injection mold at a position corresponding to the location at which the connector is to be soldered to a circuit feed. Thereafter, at 804, the process 800 includes injecting thermoplastic including additives into the injection mold to form the substrate (such as substrate 302). As discussed above, the additives included in the thermoplastic may be of a type that can be activated by a laser to be platable.

At 806, the substrate may be subjected to a laser to activate the thermoplastic in the pattern that is to be plated to form the circuit traces. At 808, the process 800 includes placing the activated substrate into an electroless copper bath to plate the activated thermoplastic and the staple that is embedded in the substrate.

At 810, the process 800 includes soldering the connector to the plated staple and the circuit feed of the plated circuit traces.

The specific soldering technique utilized may vary from implementation to implementation. For example, in some implementations, the soldering technique to be used may include reflow soldering. In reflow soldering, a solder paste (a sticky mixture of powdered solder and flux) may be used to temporarily attach the connector to the plated staple and plated circuit feed location, after which the entire substrate may be subjected to controlled heat, which melts the solder, permanently connecting the pieces. Heating may be accomplished by passing the substrate through a reflow oven or under an infrared lamp or by soldering individual joints with a hot air pencil. Of course, reflow soldering is merely an example and other soldering techniques may be used, including hand soldering with the use of a soldering iron or soldering gun or by automated production line soldering techniques. Further, non-soldering joining techniques may be used.

These and other features, variations and/or components would be apparent to one of ordinary skill in the art in view of this disclosure. An example alternative implementation is shown and described with respect to FIGS. 9 and 10.

Figure 9:
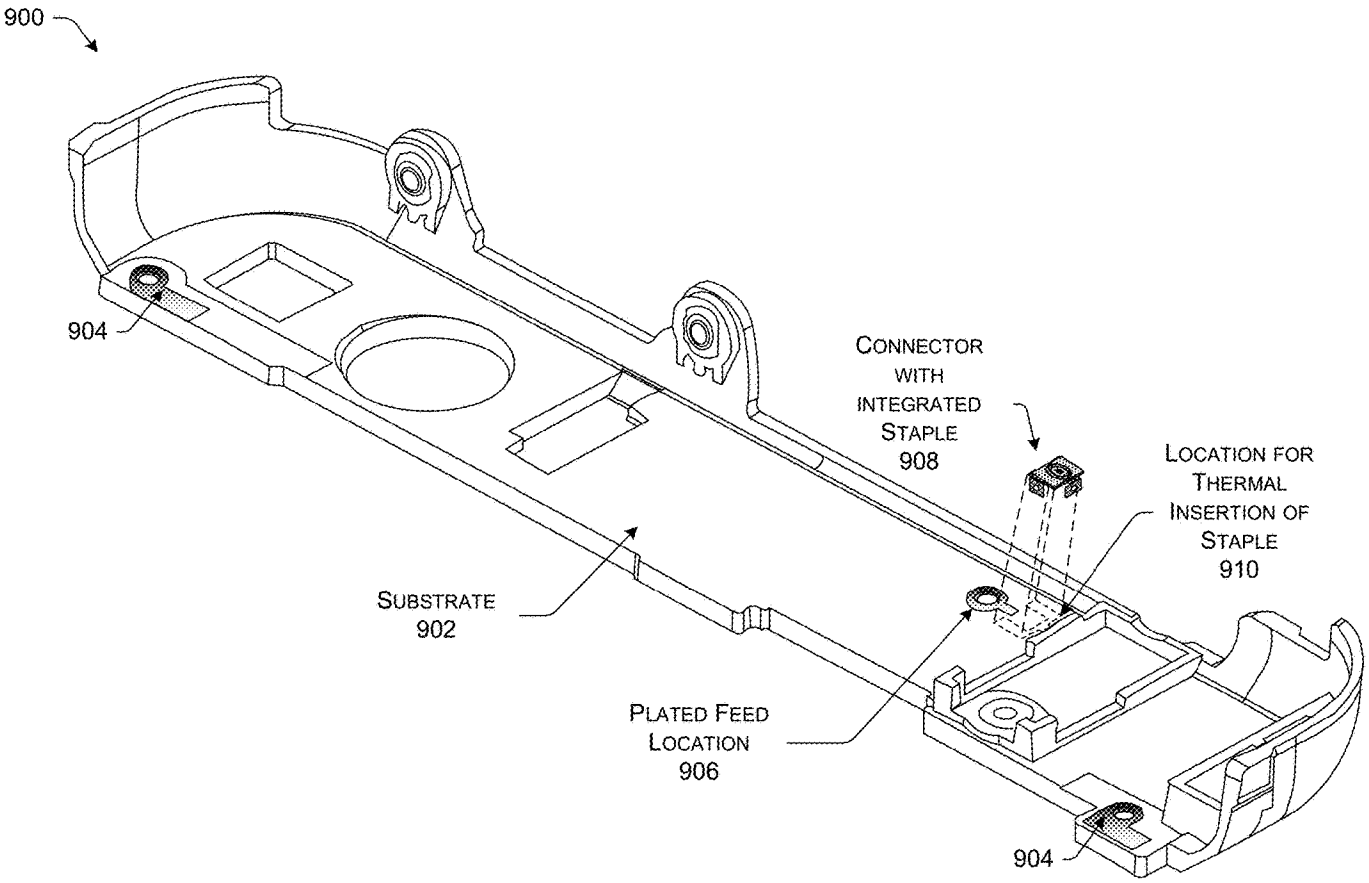
FIG. 9 illustrates a view of a substrate with plated integrated circuit traces similar to that shown in FIG. 7 but according to an implementation in which the connector is integral to the structural support, the structural support being thermally inserted at a location proximate to the plated circuit traces of the substrate.

FIG. 9 includes a view 900 of a substrate 902 according to another example implementation in which the connector and staple are integrally formed and inserted into a preformed and plated substrate using, for example, a thermal insertion technique. As shown in FIG. 9, the substrate 902 includes plated circuit traces 904 and a plated feed location 906. A connector with an integrated staple 908 is to be inserted into the location for thermal insertion of the staple 910. An example process for assembling the substrate 902 shown in FIG. 9 is set forth in FIG. 10 and described below.

Figure 10:
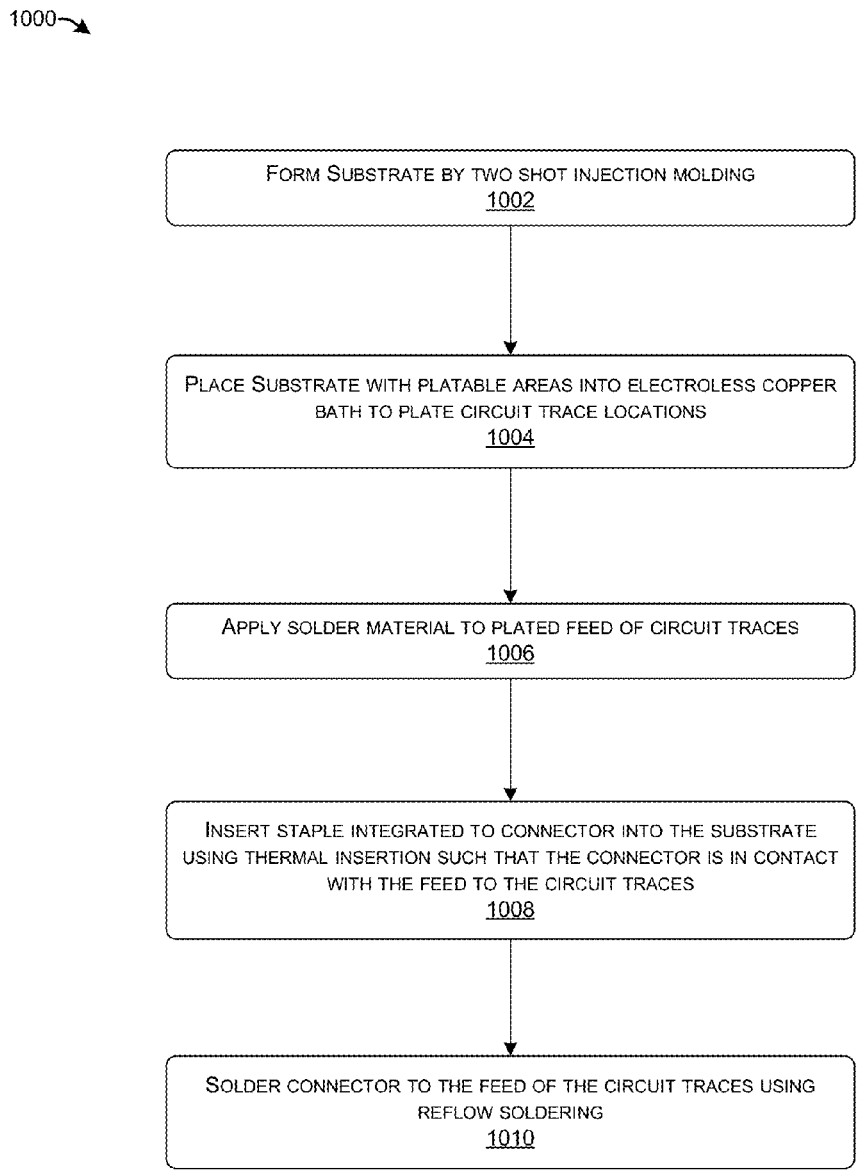
FIG. 10 illustrates an example flow diagram of a process for assembling a substrate with integrated circuit traces such as that shown in FIG. 9.

FIG. 10 illustrates an example process 1000 for assembling a substrate including circuit traces and a connector with an integrated staple, such as that shown in FIG. 9. The order in which the operations are described is not intended to be construed as a limitation, and any number of the described operations can be combined in any order and/or in parallel to implement the process. Although the substrate 902 may be formed in a similar manner to that described above for the substrate 302, the discussion below will be in the context of forming the substrate 902 using the two-shot injection molding technique.

The process 1000 includes, at 1002, forming the substrate 902 using a two shot injection molding technique. In two shot injection molding, two separate molds may be used to make the substrate. In the first "shot" of the process, the main body of the substrate 902 may be formed in the first mold. The main body may be made from, for example, a non-platable resin. The mold for the main body may include the pattern of the circuit traces as raised areas, thus imprinting the pattern of the circuit traces as shallow depressions on the main body. In the second "shot" of the process, the main body is placed in a second mold that does not include the pattern of the circuit traces. A platable resin is then injected to fill in the shallow depressions of the main body. Once the second "shot" is complete, the substrate 902 would be similar to the substrate 302 shown in FIG. 3, but with the circuit trace pattern formed of platable resin areas instead of laser activated areas.

At 1004, the substrate 902 may then be placed in an electroless copper bath to form the plated circuit traces 904 and plated feed location 906.

Once the substrate 902 has been subjected to the electroless copper bath and the plated circuit traces 904 and plated feed location 906 have been formed, the process to affix the connector 908 to the plated feed location 906 may be performed. On the other hand, while the example shown and described with respect to FIG. 9 includes affixing the connector to the substrate 902 after the plating, in other implementations, the connector 908 may be affixed prior to the substrate 902 being placed in the electroless copper bath. As discussed above, thermal insertion may be used to affix a connector with an integrated staple 908 shown in FIG. 9.

At 1006, a solder paste may be applied to the area of the circuit feed location 906 that will be covered by the connector 908.

Once the substrate 902 is prepared, at 1008, the staple integrated to connector 908 may be inserted into the substrate 902 using thermal insertion such that the connector is in contact with the feed to the circuit traces. In particular, the fins of the staple of 908 (the downward directed faces) may be heated to a temperature that will melt the thermoplastic of the substrate 902. The connector with the integrated staple 908 may then be pressed into the substrate at the location for thermal insertion of the staple 910 shown in FIG. 9. Additional operations may be performed depending on the particular properties of the thermoplastic and the particular thermal insertion technique employed to ensure that the connector with the integrated staple 908 is securely affixed to the thermoplastic of the substrate 902.

Once the connector with the integrated staple 908 is affixed, at 1010, the substrate 902 may be sent through a reflow soldering oven to melt the solder paste now situated between the plated feed location 906 and the connector with the integrated staple 908 to complete the connection between the plated feed location 906 and the connector with the integrated staple 908.

Thereafter, the connector of 908 may be utilized to connect the substrate 902 to other components or parts. Because the staple of 908 is embedded in the thermoplastic of the substrate 902, the amount of force or stress that may be applied to the connector of 908 without causing failure may be increased.

The substrates, components and processes described above and illustrated in FIGS. 1-10 are merely examples and, as such, implementations are not limited to these examples. For example, as mentioned above, the substrates according to this disclosure are not limited to substrates formed of thermoplastic. Further, the staples (or other embedded support structures) described in the example implementations are not the only shape, design or material of support structures contemplated as within the scope of the disclosure and may vary from implementation to implementation based on many factors (e.g. the composition of the substrate, the time of placement and the location of the staple in the substrate, aesthetic considerations, temperatures the substrate will be subjected when the staple is embedded within the substrate, stresses that may be applied to the staple, etc.). Moreover, while the example implementations shown above result in a connector being affixed to a circuit feed location, this is merely an example used for ease of illustration. In other words, the disclosed subject matter is not limited either in what is ultimately affixed to the circuit traces, nor to any particular area, location or type of circuit trace. For example, a variation within the scope of this disclosure may include directly affixing a cable to a desired area of the circuit traces and to a proximally located embedded support structure (e.g. a staple). More particularly, a staple or other support structure may be thermally inserted into the substrate 102 shown in FIG. 1 at an area proximate the platable areas 104; the substrate 102 may then be plated; and a cable could then be soldered to the plated staple and a proximal area of the plated circuit traces 202. Further, connectors, such as connector 702, are not limited to any specific types of connectors, such as RF connectors. In addition, though the illustrated examples show one support structure and one connector affixed thereto, implementations are not so limited. In other words, some implementations may include multiple support structures positioned proximate to multiple respective circuit traces locations and a connector affixed to some or all of the support structures and respective circuit trace locations. These and other features, variations and/or components would be apparent to one of ordinary skill in the art in view of this disclosure.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. An antenna structure of an electronic device comprising:

a thermoplastic component comprising:

a thermoplastic substrate;

one or more circuit traces formed on the thermoplastic substrate; and a metallic support structure partially embedded in the thermoplastic substrate such that a first surface of the metallic support structure is exposed, at a location proximate to at least a proximal circuit trace of the one or more circuit traces; and a connector soldered to the thermoplastic component via at least two soldering joints, the at least two soldering joints including:

a first soldering joint that joins the connector to the first surface of the metallic support structure, and a second soldering joint that joins the connector to the proximal circuit trace formed on the thermoplastic substrate, the second soldering joint electrically connecting the connector to the proximate circuit trace such that an electronic component connected to the connector is able to transmit and receive signals through at least one of the one or more circuit traces.

2. An antenna structure as recited in claim 1, wherein the thermoplastic substrate is an injection molded thermoplastic substrate.

3. An antenna structure as recited in claim 1, wherein the thermoplastic substrate is formed of a laser-activatable thermoplastic including an additive configured to cause areas subjected to laser activation to become platable by a plating process.

4. An antenna structure as recited in claim 3, wherein the one or more circuit traces are formed on the thermoplastic substrate on corresponding laser activated areas of the thermoplastic substrate.

5. A device component comprising:

a thermoplastic component comprising:

a substrate;

one or more circuit traces formed on the substrate; and a support structure separate from the one or more circuit traces, the support structure being partially embedded in the substrate such that a first surface of the metallic support structure is exposed, the support structure being embedded at a location proximate to at least a part of a circuit trace of the one or more circuit traces, wherein a portion of the substrate is disposed between the support structure and the one or more circuit traces; and a connection component connected to the thermoplastic component via at least two attachment joints, the at least two attachment joints including:

a first attachment joint connecting the connection component to the first surface of the support structure that is exposed, and a second attachment joint connecting the connection component to a portion of the part of the circuit trace.

6. A device component as recited in claim 5, wherein the connection component comprises a coupling interface configured to electrically couple the connector to an electric component, and wherein the second attachment joint electrically connects the connection component to the portion of the part of the circuit trace such that the electronic component connected to the connection component is able to transmit signals to and receive signals from the device component.

7. A device component as recited in claim 5, wherein the substrate is a thermoplastic substrate.

8. A device component as recited in claim 7, wherein the thermoplastic substrate is formed of a laser-activatable thermoplastic including an additive configured to cause areas subjected to laser activation to become platable by a plating process.

9. A device component as recited in claim 8, wherein the one or more circuit traces are formed on corresponding laser activated areas of the thermoplastic substrate.

10. A device component as recited in claim 7, wherein the thermoplastic substrate is formed of a first resin that is non-platable and a second resin that is platable.

11. A device component as recited in claim 7, wherein the support structure is embedded in the thermoplastic substrate by one of thermal insertion, ultrasonic insertion or by being placed in an injection mold used to form the thermoplastic substrate prior to thermoplastic being injected into the mold to form the thermoplastic substrate.

12. A device component as recited in claim 7, wherein the support structure comprises a metallic support structure and wherein the portion of the part of the circuit trace includes at least part of a signal location of the circuit trace.

13. A method for assembling at least a portion of a device component with integrated circuit traces, the method comprising:

forming a thermoplastic component, wherein forming the thermoplastic component comprises:

placing a metallic support structure in an injection mold for forming a thermoplastic substrate of the device component;

injecting thermoplastic into the injection mold to form the thermoplastic substrate of the device component that includes the metallic support structure; and plating one or more areas of the thermoplastic substrate to form the integrated circuit traces, a portion of the thermoplastic substrate being disposed between the integrated circuit traces and the metallic support; and joining a connection component to the thermoplastic component via at least two attachment joints, the at least two attachment joints including:

a first attachment joint connecting the connection component to the metallic support structure; and a second attachment joint connecting the connection component to a part of the integrated circuit traces.

14. A method as recited in claim 13, wherein the placing of the metallic support structure in the injection mold comprises positioning the metallic support structure such that the metallic support structure is partially embedded in the thermoplastic substrate at a location proximate to the part of the integrated circuit traces.

15. A method as recited in claim 13, wherein the joining comprises soldering the connection component to the metallic support structure and the part the integrated circuit traces such that an electronic component electrically connected to the connection component is able to transmit signals to and receive signals from the device component.

16. A method as recited in claim 13, wherein the injected thermoplastic comprises laser-activatable thermoplastic including an additive configured to cause areas subjected to laser activation to become platable, the method further comprising:

activating areas of the thermoplastic substrate corresponding to the integrated circuit traces using a laser.

17. A method as recited in claim 13, wherein the injection mold is a first injection mold including raised areas corresponding to a pattern of the integrated circuit traces and wherein the thermoplastic injected into the first injection mold comprises a first thermoplastic that is non-platable, the method further comprising:

following the injecting thermoplastic into the first injection mold to form the substrate, placing the substrate in a second injection mold; and injecting a second thermoplastic that is platable into the second injection mold to fill depressions in the thermoplastic substrate corresponding to the raised areas included in the first injection mold that correspond to the pattern of the integrated circuit traces of the device component.

18. An antenna structure as recited in claim 1, wherein the metallic support structure is a first metallic support structure, the proximal circuit trace is a first proximal circuit trace, and the connector is a first connector, and wherein the thermoplastic component further comprises a second metallic support structure embedded in the thermoplastic substrate such that a second surface of the second metallic support structure is exposed, at a second location proximate to at least a second proximal circuit trace of the one or more circuit traces formed on the thermoplastic substrate, and wherein the antenna structure further comprises:

a second connector soldered to the thermoplastic component via at least two additional soldering joints, the at least two additional soldering joints including:

a third soldering joint connecting the second connector to the second surface of the second metallic support structure that is exposed, and a fourth soldering joint connecting the connector to the second proximal circuit trace.

19. An antenna structure as recited in claim 1, wherein a portion of the thermoplastic substrate is disposed between the metallic support structure and the one or more circuit traces.

20. An antenna structure as recited in claim 1, wherein the metallic support structure is a staple, the staple comprising:

the first surface, wherein the first surface is configured to be soldered to the connector; and one or more projections embedded in the thermoplastic substrate.

* * * * *